US007460083B2

(12) United States Patent
Parsche et al.

(10) Patent No.: US 7,460,083 B2
(45) Date of Patent: Dec. 2, 2008

(54) ANTENNA ASSEMBLY AND ASSOCIATED METHODS SUCH AS FOR RECEIVING MULTIPLE SIGNALS

(75) Inventors: Francis E. Parsche, Palm Bay, FL (US); Richard Folio, Melbourne, FL (US); George A. Waschka, Jr., Melbourne Beach, FL (US)

(73) Assignee: Harris Corporation, Melbourne, FL (US)

( * ) Notice: Subject to any disclaimer, the term of this patent is extended or adjusted under 35 U.S.C. 154(b) by 121 days.

(21) Appl. No.: 11/733,296

(22) Filed: Apr. 10, 2007

(65) Prior Publication Data

US 2008/0252545 A1 Oct. 16, 2008

(51) Int. Cl.
*H01Q 1/36* (2006.01)

(52) U.S. Cl. ..... 343/895; 343/799; 343/846

(58) Field of Classification Search ..... 343/895, 343/700 MS, 846, 799
See application file for complete search history.

(56) References Cited

U.S. PATENT DOCUMENTS

| | | | | |
|---|---|---|---|---|
| 2,863,145 | A | 12/1958 | Turner | 343/767 |
| 2,935,746 | A | 5/1960 | Marston et al. | 343/761 |
| 2,969,542 | A | 1/1961 | Coleman et al. | 343/761 |
| 3,131,394 | A | 4/1964 | Wheeler | 343/895 |
| 3,144,648 | A | 8/1964 | Dollinger | 343/100 |
| 3,299,355 | A | 1/1967 | Jenks et al. | 325/31 |
| 4,085,406 | A | 4/1978 | Schmidt et al. | 343/895 |
| 4,095,230 | A | 6/1978 | Salmond et al. | 343/729 |
| 4,143,380 | A | 3/1979 | Kyle | 343/895 |
| 4,503,101 | A | 3/1985 | Bennett | |
| 4,608,572 | A | 8/1986 | Blakney et al. | 343/792.5 |
| 5,990,835 | A | 11/1999 | Kuntzsch et al. | 343/700 |
| 6,424,317 | B2 | 7/2002 | Rudish | 343/895 |
| 6,441,740 | B1 * | 8/2002 | Brady et al. | 340/572.7 |

* cited by examiner

*Primary Examiner*—Hoang V Nguyen
(74) *Attorney, Agent, or Firm*—Allen, Dyer, Doppelt, Milbrath & Gilchrist, P.A.

(57) ABSTRACT

The antenna assembly is circularly polarized and may be able to receive multiple independent signals. The antenna assembly includes a plurality of electrically conductive layers arranged about an axis to define a series of adjacent corner reflectors (e.g. four to eight corner reflectors), and a plurality of spiral antenna elements. Each spiral antenna element extends across a respective open end of a corresponding corner reflector. Each corner reflector may have an equal corner angle, and each spiral antenna element may be a bifilar spiral antenna element and/or a log spiral antenna element. A housing may contain the corner reflectors and the spiral antenna elements. Electronic circuitry may be coupled to the plurality of spiral antenna elements and contained within the housing. The antenna is preferential for television reception on multiple channels and directions without consumer adjustment, as the antenna provides spatial, angular and frequency diversity through simultaneous overlapping beams.

23 Claims, 6 Drawing Sheets

ANTENNA ASSEMBLY AND ASSOCIATED METHODS SUCH AS FOR RECEIVING MULTIPLE SIGNALS

FIELD OF THE INVENTION

The present invention relates to the field of communications, and, more particularly, to antennas for wireless communications, e.g. television, and related methods.

BACKGROUND OF THE INVENTION

There may be difficulties obtaining clear television pictures with television sets and antennas situated interior to dwellings. The signals penetrating houses and apartments are attenuated and reflected causing the reception to be weak and producing multiple reflected signals due to reflections from within and outside of the building. These reflected signals arriving from different directions and different paths result in undesirable ghosts or multiple pictures in the video reproduction. In this indoor signal environment the television set owner typically uses "rabbit ears," an antenna including variable length swiveled or pivoted dipole/loop elements located on top or near the television receiver (e.g. as disclosed in U.S. Pat. No. 3,478,361). The operator adjusts the length and orientation of dipole elements to increase the signal strength and reduce the multiple reflection causing visible multiple pictures or ghosts on the television screen.

While the above discussed problems regarding ghosts and multiple pictures may be associated with the National Television System Committee (NTSC) standard for analog television transmission, the transition to the Advanced Television System Committee (ATSC) standard that defines digital TV (DTV) transmission is already underway. The effect of multipath (reflections) on digital signals is more severe. It is a characteristic of digital transmissions that they are generally received perfectly or not at all with the transition region in signal strength being very sharp. Thus, in a marginal reception area such as indoors, a slight increase in signal strength due to the gain of the antenna or the rejection of a reflected signal due to the directivity may result in the difference between receiving a signal and not receiving it at all.

Although other indoor television antennas exist using configurations of loops, dipoles, wires, and electrical circuits, these existing antennas are deficient in directivity and gain needed to receive desired direct signals and to discriminate against reflected and depolarized signals. Impedance matching is often circuits which are non-compensating with frequency change. Existing indoor antennas may not have accurate and repeatable mechanisms for repositioning and tuning on different channels. Further disadvantages of existing indoor TV antennas include the complexity of matching circuits, some of which need electrical power and the large physical dimensions of dipoles and loops.

Conventional VHF/UHF television broadcast receiving antennas are typically designed to receive signals from only one direction. They are often referred as "unidirectional antennas." This unidirectional feature rejects undesirable multipath signals, which may cause multipath or "ghost" interference problems.

Circularly polarized waves can have a useful property of reversing sense upon being reflected. For instance, a right hand circularly polarized (RHCP) wave bouncing off a metal building becomes left hand circularly polarized (LHCP). Television systems transmitting and receiving with circularly polarized (CP) antennas can reject many reflected signals due to their crossed senses of rotation, reducing ghosting in analog TV or aliasing in digital TV.

Frequency reuse and channel diversity increasingly require antennas with multiple look angles and broad instantaneous bandwidths. Television broadcasting may someday benefit from cellular like infrastructures, in which programming is received simultaneously from multiple directions and frequencies.

Various antennas and/or reflectors, such as broadband antennas and spiral antennas, are disclosed in U.S. Pat. Nos. 2,863,145, 2,969,542, 3,131,394, 3,144,648, 3,299,355, 4,085,406, 4,095,230, 4,143,380, 4,503,101, 4,608,572, 5,990,835, and 6,424,317.

However, there is a need for a relatively inexpensive indoor home TV antenna that is circularly polarized, is able to receive multiple simultaneous beams, and includes instantaneous broadband spatial response, i.e. may output all VHF/UHF channels by all azimuthal beams simultaneously.

SUMMARY OF THE INVENTION

In view of the foregoing background, it is therefore an object of the present invention to provide an antenna assembly that is circularly polarized and able to receive multiple independent signals.

This and other objects, features, and advantages in accordance with the present invention are provided by an antenna assembly including a plurality of electrically conductive layers arranged about an axis to define a series of adjacent corner reflectors (e.g. four to eight corner reflectors), and a plurality of spiral antenna elements, each spiral antenna element extending across a respective open end of a corresponding corner reflector. The antenna assembly is preferably circularly polarized and able to receive multiple independent signals, i.e. multiple simultaneous beams. Accordingly, the antenna assembly may include instantaneous broadband spatial response, i.e. may output all UHF channels by all azimuthal beams simultaneously. The antenna assembly in accordance with the features of the present invention preferably operates as an indoor TV antenna with multiple look angles (i.e. receiving multiple/independent signals or channels, such as from different sites).

Each corner reflector may have an equal corner angle, and each spiral antenna element may include a dielectric substrate and at least one electrically conductive layer thereon. Also, each spiral antenna element may comprise a bifilar spiral antenna element and/or a log spiral antenna element. Furthermore, there may be at least one dielectric layer between adjacent electrically conductive layers.

The antenna assembly may also include a plurality of antenna feed structures, each antenna feed structure extending radially inwardly from a medial portion of a respective spiral antenna element. A housing may contain the corner reflectors and the spiral antenna elements. Electronic circuitry may be coupled to the plurality of spiral antenna elements and contained within the housing.

A method aspect in accordance with the features of the present invention is directed to a method of making an antenna assembly including arranging a plurality of electrically conductive layers about an axis to define a series of adjacent corner reflectors, and providing a plurality of spiral antenna elements including extending each spiral antenna element across a respective open end of a corresponding corner reflector.

The plurality of electrically conductive layers may be arranged so that each corner reflector has an equal corner angle and/or to define between four to eight corner reflectors.

Also, providing each spiral antenna element may comprise forming at least one electrically conductive layer on a dielectric substrate, forming a bifilar spiral antenna element and/or forming a log spiral antenna element.

The method may also include connecting an antenna feed structure to extend radially inwardly from a medial portion of a respective spiral antenna element, and providing a housing to contain the corner reflectors and the spiral antenna elements. Electronic circuitry may be coupled to the plurality of spiral antenna elements and contained within the housing.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
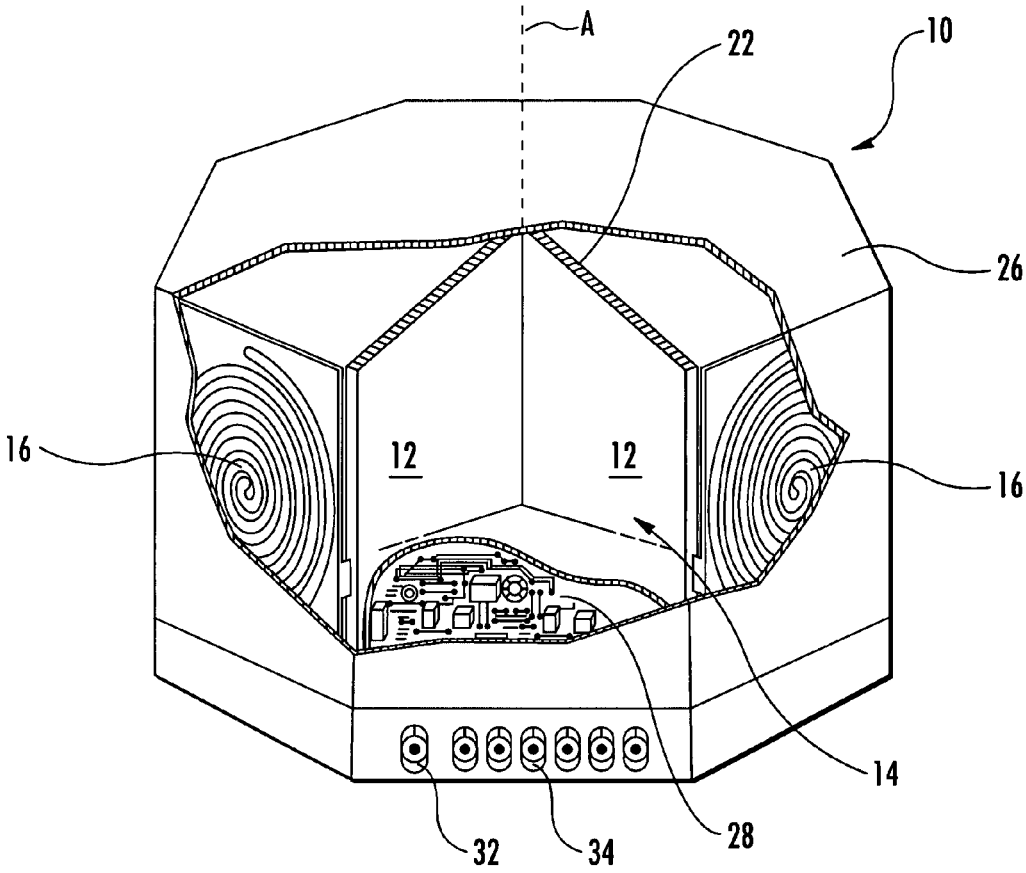
FIG. 1 is a cut-away perspective view of an example of an embodiment of an antenna assembly in accordance with features of the present invention.
Figure 2:
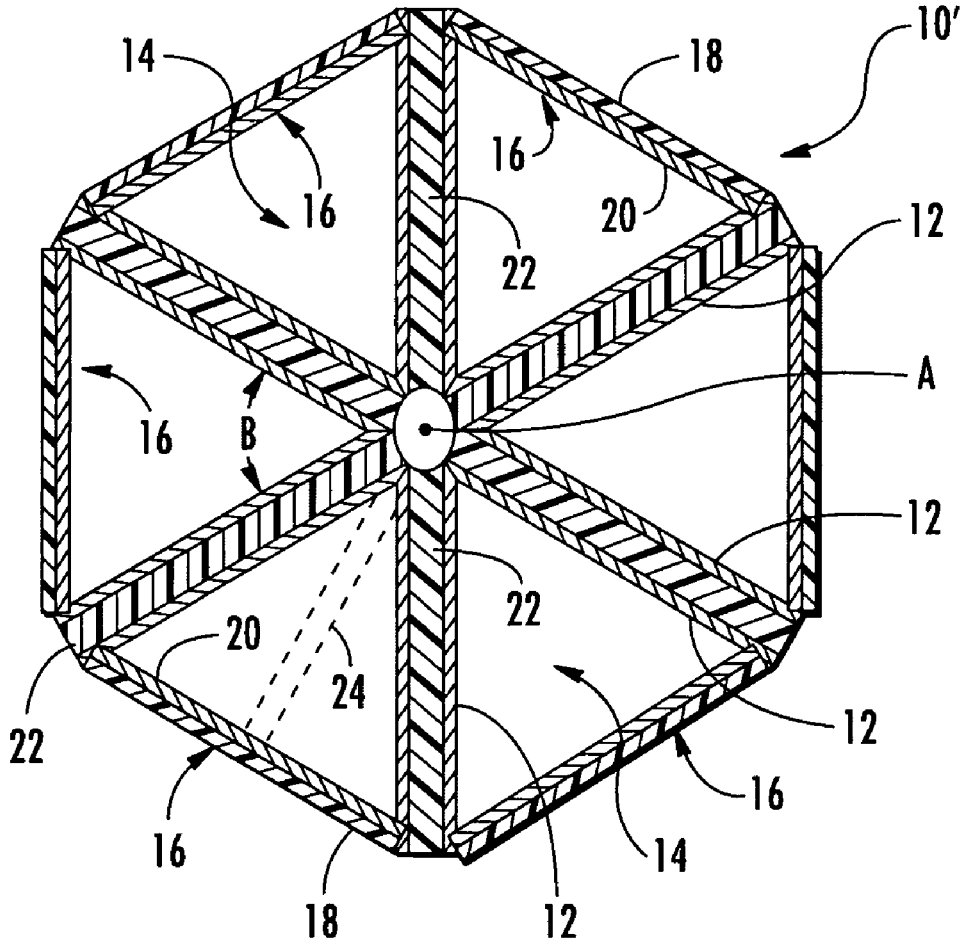
FIG. 2 is a cross-sectional view of another example of an embodiment of an antenna assembly in accordance with features of the present invention.

Referring initially to FIGS. 1 and 2, an antenna assembly 10, 10' in accordance with features of the present invention will be described. The antenna assembly 10, 10' is circularly polarized and able to receive multiple independent signals, i.e. multiple simultaneous beams. The antenna assembly 10, 10' may provide instantaneous broadband spatial response, i.e. may output all UHF channels by all azimuthal beams simultaneously.

The antenna assembly 10, 10' includes a plurality of electrically conductive layers 12 arranged about an axis A to define a series of adjacent corner reflectors 14 (e.g. four to eight corner reflectors). There may be dielectric layers 22 between adjacent electrically conductive layers 12. Illustratively, the embodiment depicted in FIG. 1 includes eight corner reflectors 14 to define an octagonal assembly 10, while the embodiment depicted in FIG. 2 includes six corner reflectors 14 to define a hexagonal assembly 10'. A plurality of spiral antenna elements 16 are included, and each spiral antenna element 16 extends across a respective open end of a corresponding corner reflector 14.

Each corner reflector 14 may have an equal corner angle B, e.g. 45 degree corner angles B in the embodiment of the assembly 10 depicted in FIG. 1, or 60 degree corner angles B in the embodiment of the assembly 10' of FIG. 2. For example, the corner reflectors 14 may be conductive/reflective material e.g. aluminum foil, as the electrically conductive layer 12, on cardboard or plastic, as the dielectric layer 22.

Figure 3:
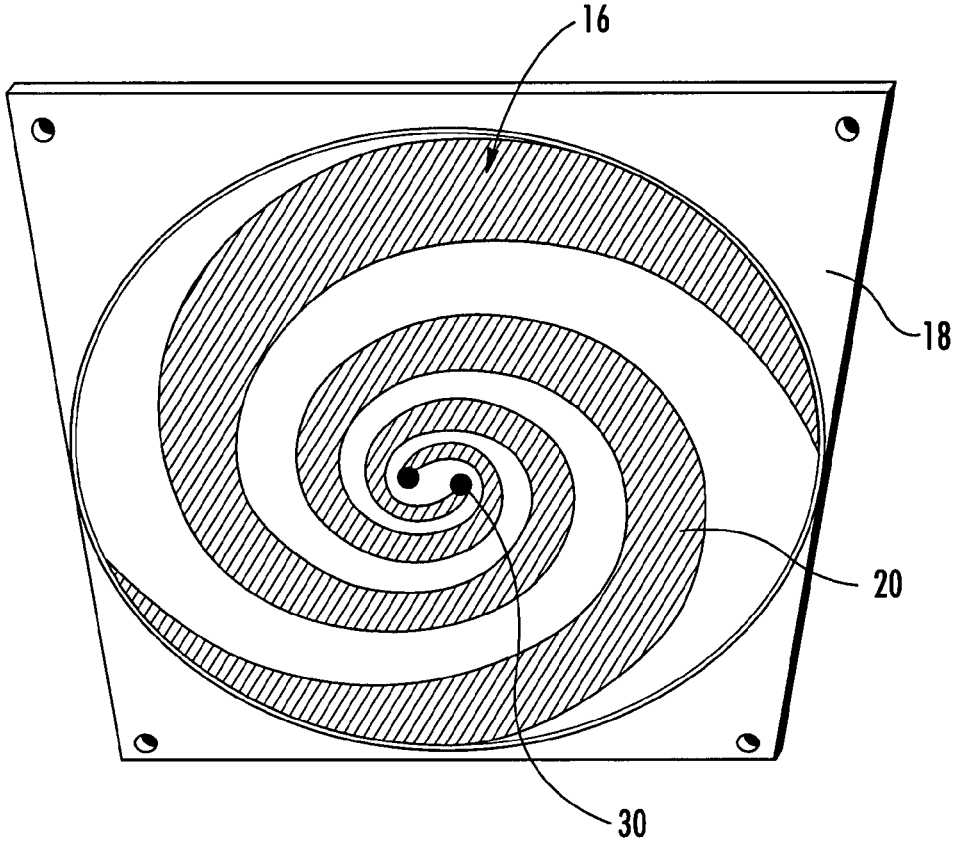
FIG. 3 is perspective view of an example of a planar spiral antenna for the antenna assembly of FIG. 1 or 2.

Each spiral antenna element 16 may include a dielectric substrate 18 and at least one electrically conductive layer 20 thereon. Also, each spiral antenna element 16 may be a bifilar (2arm) spiral antenna element and/or a log bifilar spiral antenna element, e.g. as illustrated in FIG. 3. Single arm spirals are shown in FIG. 1 only for the sake of clarity in the system illustration. For example, the spiral antenna elements 16 may be conductive ink/paint (Al or Ag), as the electrically conductive layer 20, on paper or Liquid Crystal Polymer (LCP), as the dielectric substrate 18.

The antenna assembly may also include a plurality of antenna feed structures 24 (FIG. 2), for example extending radially inwardly from a medial portion, e.g. adjacent feedpoints 30, of a respective spiral antenna element. For example, the antenna feed structure 24 may be a three-post candelabra balun or ferrite core transmission line transformer, as would be appreciated by those skilled in the art.

A housing 26 may contain the corner reflectors 14 and the spiral antenna elements 16. Electronic circuitry 28 may be coupled to the plurality of spiral antenna elements 16 and contained within the housing 26. The housing 26 may contain the electronic circuitry below the spiral antenna elements 16 and corner reflectors 14, e.g. as illustrated in the embodiment of the assembly 10 depicted in FIG. 1.

An antenna assembly 10, 10' in accordance with the features of the present invention preferably operates as an indoor TV antenna with multiple look angles (i.e. receiving multiple/independent signals or channels, such as from different sites). The antenna assembly 10, 10' is mainly a reception antenna but possible transmission capability may be provided for on-demand programming, for example, as would be appreciated by the skilled artisan.

Further details of a specific example of the antenna assembly 10, 10' will now be described. The housing 26 may be made from corrugated polyethylene, or plastic cardboard, and includes two sections. A top section includes the spiral antenna elements 16 and corner reflectors 14, while the bottom section includes the electronic circuitry 28. The spiral antenna elements 16 may be approximately 9 to 12" square and are printed with conductive (Al or Ag) ink/paint on ceramic coated photo paper and may be bonded to the interior face of the housing walls or sides. The bottom section of the housing 26 including the electronic circuitry may be approximately 1" tall. All internal surfaces of the top section of the housing 26 except the back of the spiral elements 16 are covered with conductive film, e.g. aluminum foil. One external panel of the bottom of the housing 26 may have a standard coaxial DC power jack 32 and F-type (cable TV) connectors 34.

A table summarizing various parameter values in accordance with a specific example of an antenna assembly 10, 10' of the present invention, is provided below.

EXAMPLE SUMMARY

| Parameter | Value | Basis |
|---|---|---|
| Antenna Type | Bifilar (2 Arm) Log Spiral, $\tau = 10°$ | Configured |
| Cavity Type | 60 degree corner reflector | Configured |
| Frequency Range | 470-806 Mhz, TV Ch. 14-69, inclusive and 54 to 216 Mhz, TV Ch 2-13 inclusive | Specified |
| VHF Matching | Active using high impedance FET preamp | Configured |
| UHF Matching | Passive using 4 to 1 balun | Configured |
| UHF Gain | +4.9 dBic | Measured |
| Azimuthal Plane Half | 96 Degrees, 470 Mhz<br>60 Degrees, 800 Mhz | Measured |

-continued

EXAMPLE SUMMARY

| Parameter | Value | Basis |
|---|---|---|
| Power | | |
| Beamwidth | | |
| Polarization | Circular | Specified |
| Polarization Axial Ratio | 7 dB at 470 Mhz, 5 dB at 630 Mhz, 7 dB at 800 Mhz. Major axis horizontal | Measured |
| VSWR | <2.5 to 1 | Measured |
| Impedance | 50 Ω (75 Ω at nominal VSWR increase) | Specified |
| Balun/ Matching | 3 Post Candelabra (also suitable for ferrite) | Configured |
| Spiral Size | 12 inch diameter | Configured |
| Construction | Spiral: G10 PWB (or paper & conductive ink); Cavity: Al Foil | Configured |

Figure 4A:
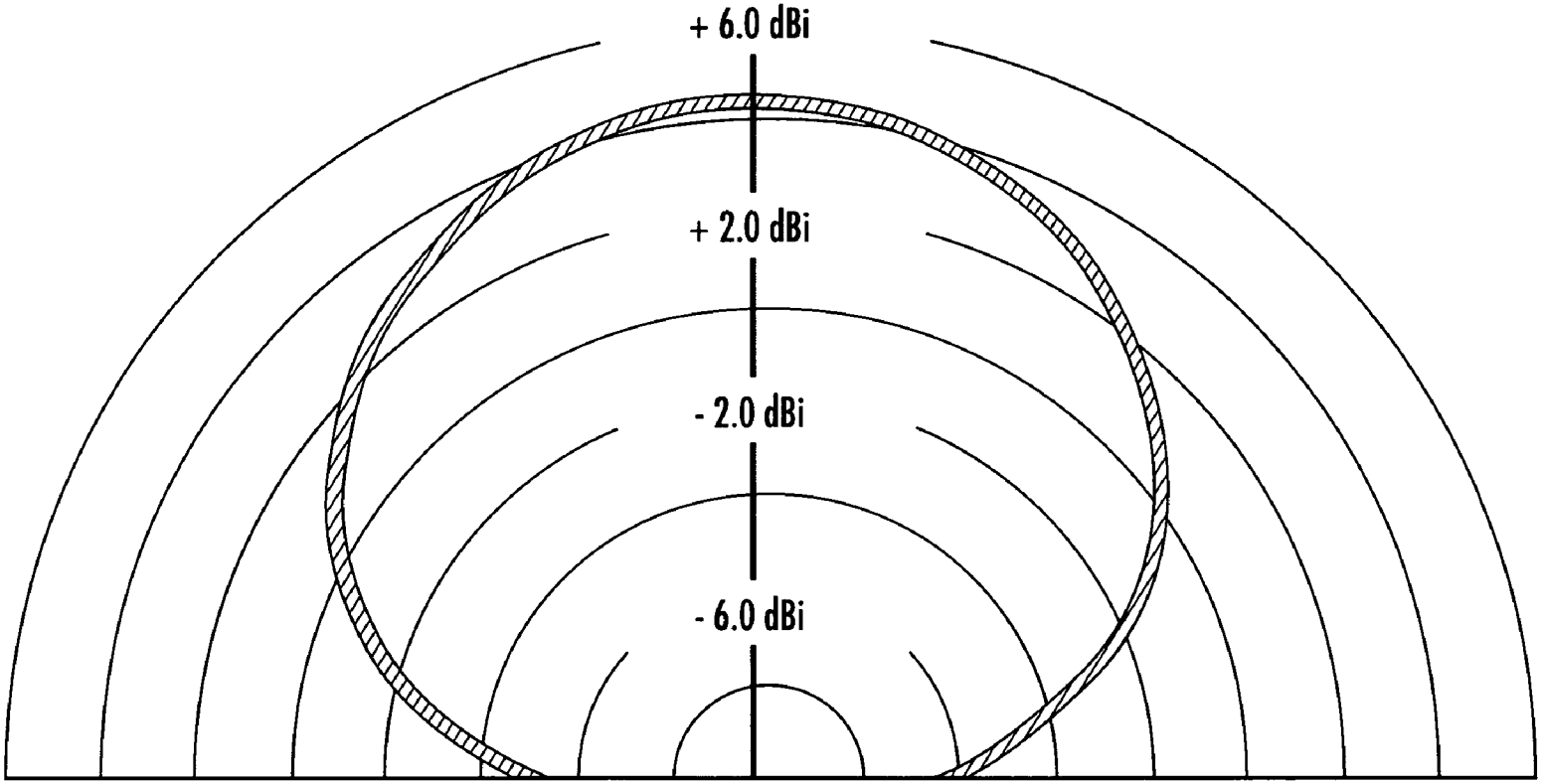
FIGS. 4A-4C are radiation pattern plots illustrating the measured gain of an example of an antenna assembly in accordance with features of the present invention.
Figure 4B:
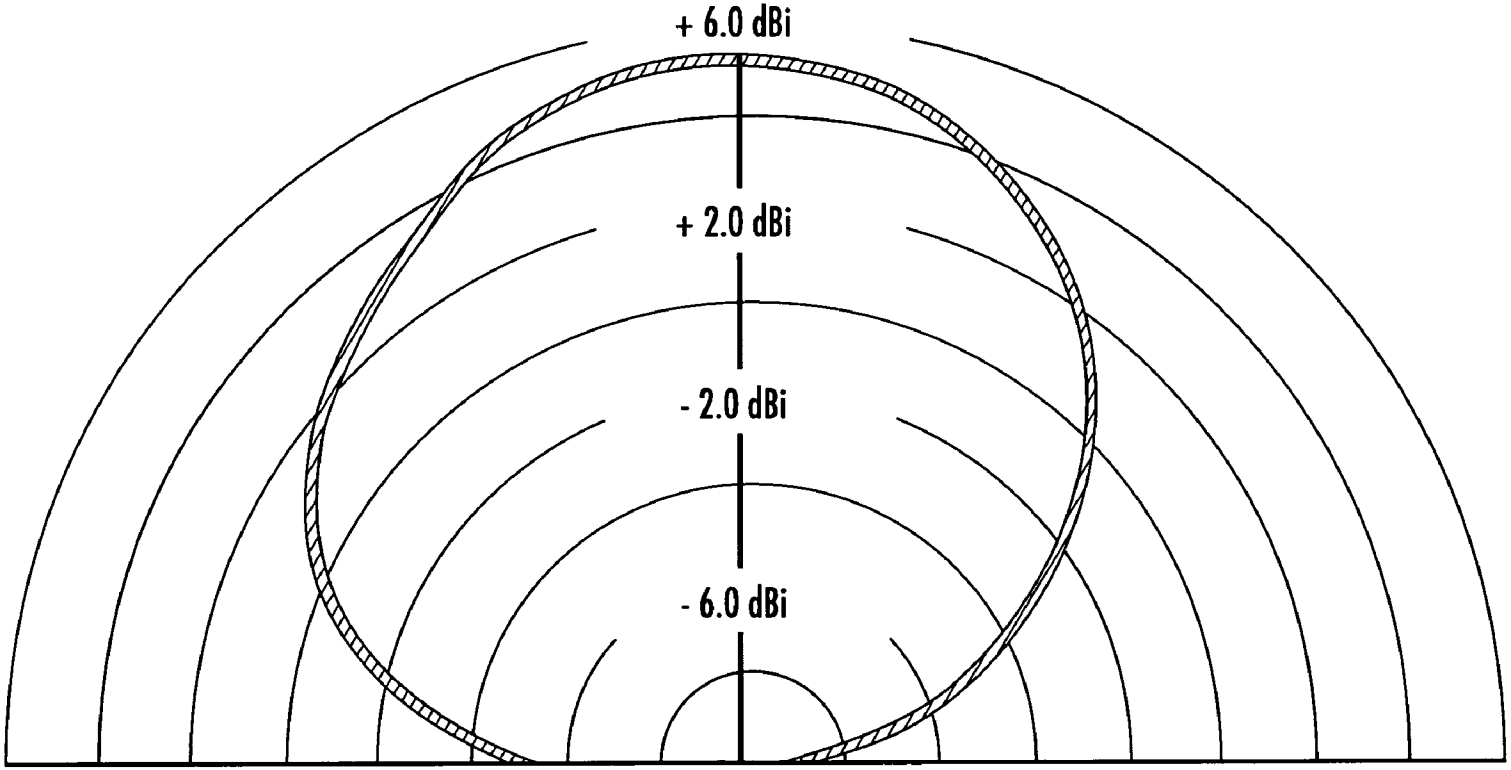
Figure 4C:
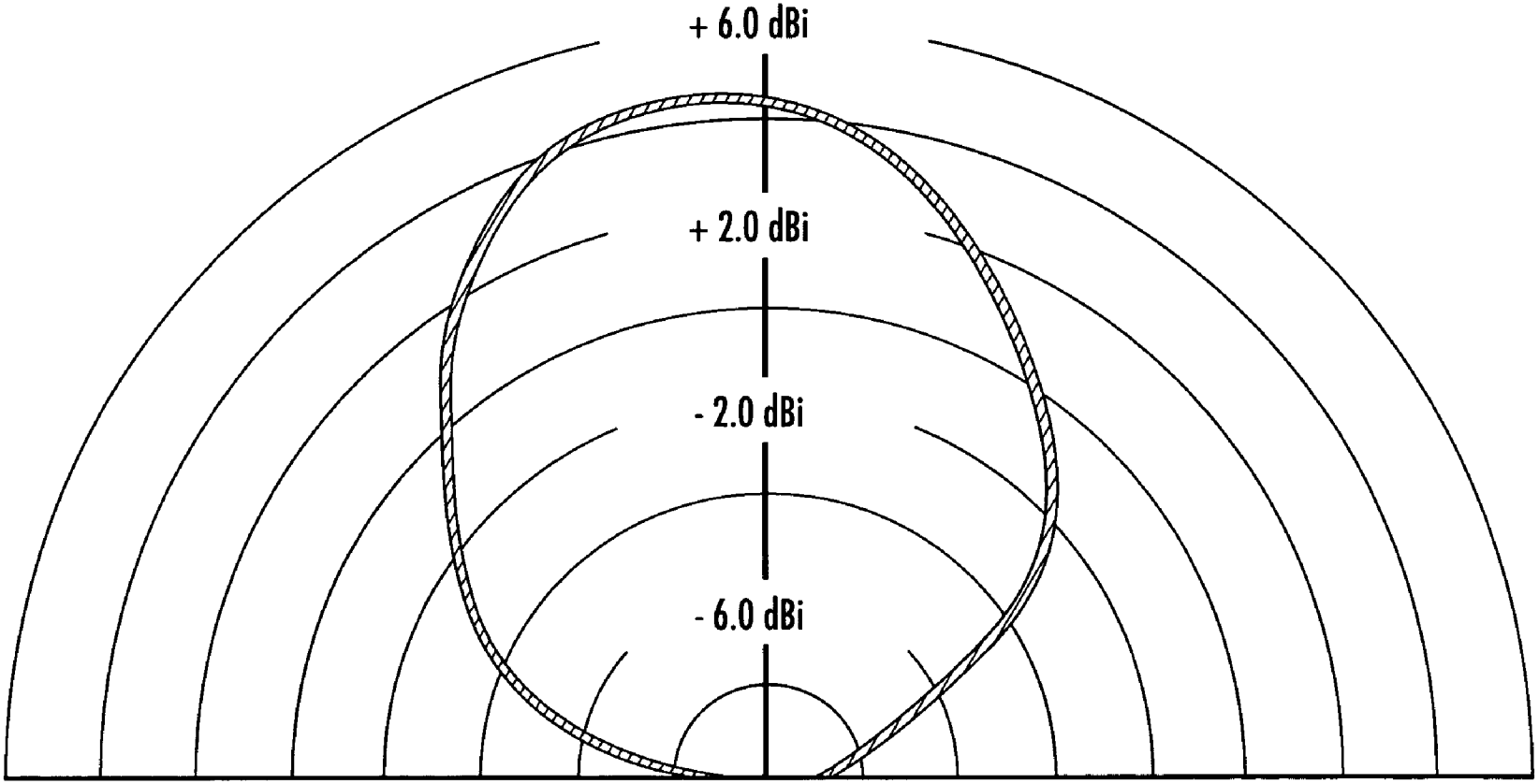

FIGS. 4A-4C are graphs illustrating the measured gain of an example of antenna assembly 10, 10' in accordance with features of the present invention. FIG. 4A illustrates the measured gain in dBic at 470 MHz, about channel 14 USA NTSC. FIG. 4B illustrates the measured gain in dBic at 630 MHz, about Channel 40 USA NTSC. FIG. 4C illustrates the measured gain in dBic at 800 MHz, about channel 69 USA NTSC. Units of dBic refer to measurements made with a circularly polarized source antenna, while the reference antenna is an isotropic antenna.

The conductive paint antenna implementation, e.g. on LCP substrate, is possible due to high spiral circuit resistances. The spiral antenna elements 16 are operated in panel mode (not slot mode). It will be appreciated that the embodiment including the 60 degree corner reflectors 14 forming a hexagonal system housing is advantageous for various reasons including compactness of the elements versus operation quality. Such an antenna assembly 10, 10' may be used in a cellular television system, including simultaneous azimuths and passbands.

As can be apparent to those skilled in the art, spiral antenna elements 16 are planar and among the smallest of the frequency independent broadband antennas. Since spirals are broadband and planar, they are inexpensive to manufacture by printed circuit (PCB or PWB) techniques without difficult tolerances. Two arm spirals are preferentially about ⅓ of a wavelength in diameter for circular polarization and operation without active matching. The reference *"The Equiangular Spiral Antenna"*, John D. Dyson, IEEE Transactions On Antennas and Propagation, April 1959, pp 181-187 is incorporated herein by reference in its entirety.

Spiral antenna elements 16 may be operated as unresonated active antennas at VHF. That is, the spiral elements 16 are effective even at electrically small size below typical cutoff by direct connection to high input impedance preamplifiers. Field effect transistors (FET or JFET) readily provide megaohm input impedances and low noise figures for this purpose. Series capacitors may be used between the balun and the antenna driving points to split the high impedance VHF signals from the lower impedance UHF signals, and the VHF signals removed through series "RF choke" inductors, which will of course pass high impedances. As background, active antennas may be electrically small receiving antennas that are matched by direct connection to RF amplifiers with resonating components.

A 9 to 12 inch diameter two arm spiral is especially suited for "active matching" at VHF as there it becomes a horizontally polarized standing wave type antenna, an antenna capable of resisting the typically strong vertically polarized near E field electromagnetic interference (EMI), common at lower frequencies in urban areas. The same 9 to 12 inch diameter two arm spiral becomes a circularly polarized traveling wave antenna at UHF, an antenna capable of resisting fading and ghosts, which may be common at higher frequencies in urban areas.

As will be apparent to those in the art, VHF television can be more severely impacted by electromagnetic interference than UHF television, and UHF television can be more severely impacted by reflections and ghosting than VHF television. AC power lines may radiate EMI over broad areas, with the power line conductors mimicing skeleton slot dipoles at radio frequencies (RF). The skeleton slot dipole (e.g. see U.S. Pat. Nos. 2,687,475 and 2,755,465) is an antenna type that creates strong near electric fields. As power lines in the USA increasingly stack the wire conductors (EMI skeleton slot dipoles) vertically to eliminate cross arms, urban near electric field EMI may increasingly becoming more and more vertically polarized. The present invention offers an approach to mitigate this vertically polarized EMI at VHF when the two arm spiral is oriented such that the spiral arms end in a horizontal plane and the spiral diameter d is small relative to wavelength, e.g. about $d<\lambda/10$ The antenna assembly 10, 10' may not need to be continually adjusted depending on the channel or the directionality of the incoming signal, a significant operating convenience for consumers. Installation becomes more "foolproof" as well, as the consumer does not need to know the location of the transmitting site. The antenna assembly 10, 10' may be low-cost, lightweight, and capable of operating over the 54-88, 174-216 MHz and 470-806 MHz frequency ranges.

A method aspect in accordance with the features of the present invention is directed to a method of making an antenna assembly 10, 10' including arranging a plurality of electrically conductive layers 12 about an axis A to define a series of adjacent corner reflectors 14, and providing a plurality of spiral antenna elements 16 including extending each spiral antenna element 16 across a respective open end of a corresponding corner reflector 14.

The plurality of electrically conductive layers 12 may be arranged so that each corner reflector 14 has an equal corner angle B and/or to define between four to eight corner reflectors. Also, providing each spiral antenna element 16 may comprise forming at least one electrically conductive layer 20 on a dielectric substrate 18, forming a bifilar spiral antenna element and/or forming a log spiral antenna element (e.g. as shown in FIG. 3).

The method may also include connecting an antenna feed structure 24 to extend radially inwardly from a medial portion of a respective spiral antenna element 16, and providing a housing 26 to contain the corner reflectors 14 and the spiral antenna elements 16. Electronic circuitry 28 may be coupled to the plurality of spiral antenna elements 16 and contained within the housing 26.

The two arm spiral may be thought of as a figure of rotation of a straight dipole, such that dipole half elements become the two spiral arms. The dipole is of course well proven in television service, e.g. the "rabbit ears". Thus in the present invention, the venerable "rabbit ears" dipole may be thought of as being rotated to become a modern circularly polarized two arm spiral. A modern assembly or system of antennas is provided, for broadband reception on multiple channels and in multiple directions simultaneously.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna assembly comprising:

a plurality of electrically conductive layers arranged about an axis to define a series of adjacent corner reflectors; and a plurality of spiral antenna elements, each spiral antenna element extending across a respective open end of a corresponding corner reflector.

2. The antenna assembly of claim 1, wherein each corner reflector has an equal corner angle.

3. The antenna assembly of claim 1, wherein said plurality of corner reflectors comprises between four to eight corner reflectors.

4. The antenna assembly of claim 1, wherein each spiral antenna element comprises a dielectric substrate and at least one electrically conductive layer thereon.

5. The antenna assembly of claim 1, wherein each spiral antenna element comprises a bifilar spiral antenna element.

6. The antenna assembly of claim 1, wherein each spiral antenna element comprises a log spiral antenna element.

7. The antenna assembly of claim 1, further comprising at least one dielectric layer between adjacent electrically conductive layers.

8. The antenna assembly of claim 1, further comprising a plurality of antenna feed structures, each antenna feed structure extending radially inwardly from a medial portion of a respective spiral antenna element.

9. The antenna assembly of claim 1, further comprising a housing containing said corner reflectors and said spiral antenna elements.

10. An antenna assembly comprising:

a plurality of electrically conductive layers arranged about an axis to define a series of adjacent corner reflectors;

a plurality of spiral antenna elements, each spiral antenna element extending across a respective open end of a corresponding corner reflector;

a plurality of antenna feed structures, each antenna feed structure extending radially inwardly from a medial portion of a respective spiral antenna element;

electronic circuitry coupled to said plurality of spiral antenna elements; and a housing containing said corner reflectors, said spiral antenna elements, said antenna feed structures and said electronic circuitry.

11. The antenna assembly of claim 10, wherein each corner reflector has an equal corner angle.

12. The antenna assembly of claim 10, wherein said plurality of corner reflectors comprises between four to eight corner reflectors.

13. The antenna assembly of claim 10, wherein each spiral antenna element comprises a dielectric substrate and at least one electrically conductive layer thereon.

14. The antenna assembly of claim 10, wherein each spiral antenna element comprises a bifilar spiral antenna element.

15. The antenna assembly of claim 10, wherein each spiral antenna element comprises a log spiral antenna element.

16. A method of making an antenna assembly comprising:

arranging a plurality of electrically conductive layers about an axis to define a series of adjacent corner reflectors; and providing a plurality of spiral antenna elements including extending each spiral antenna element across a respective open end of a corresponding corner reflector.

17. The method of claim 16, comprising arranging the plurality of electrically conductive layers so that each corner reflector has an equal corner angle.

18. The method of claim 16, comprising arranging the plurality of electrically conductive layers to define between four to eight corner reflectors.

19. The method of claim 16, wherein providing each spiral antenna element comprises forming at least one electrically conductive layer on a dielectric substrate.

20. The method of claim 16, wherein providing each spiral antenna element comprises forming a bifilar spiral antenna element.

21. The method of claim 16, wherein providing each spiral antenna element comprises forming a log spiral antenna element.

22. The method of claim 16, further comprising connecting an antenna feed structure to extend radially inwardly from a medial portion of a respective spiral antenna element.

23. The method of claim 16, further comprising providing a housing to contain the corner reflectors and the spiral antenna elements.

* * * * *